United States Patent [19]

Bell

[11] Patent Number: 5,046,621

[45] **Date of Patent: * Sep. 10, 1991**

[54] TAMPER EVIDENT NOTCHED SEALING ENVELOPE

[75] Inventor: Gary M. Bell, Crystal, Minn.

[73] Assignee: Kapak Corporation, St. Louis Park, Minn.

[ * ] Notice: The portion of the term of this patent subsequent to Oct. 9, 2007 has been disclaimed.

[21] Appl. No.: 530,926

[22] Filed: May 30, 1990

Related U.S. Application Data

[63] Continuation of Ser. No. 443,821, Nov. 30, 1989, Pat. No. 4,961,503, which is a continuation of Ser. No. 169,376, Mar. 17, 1988, abandoned.

[51] Int. Cl.[5] ..... B65D 3/26

[52] U.S. Cl. ..... 206/627; 206/632; 206/618

[58] Field of Search ..... 206/610, 627, 632, 618

[56] References Cited

U.S. PATENT DOCUMENTS

| | | |
|---|---|---|
| Re. 30,726 | 9/1981 | Otten et al. . |
| 841,699 | 1/1907 | Lawson . |
| 2,718,828 | 9/1955 | Buda et al. . |
| 3,070,280 | 12/1962 | Richmond . |
| 3,246,833 | 4/1966 | Schlienz et al. . |
| 3,310,225 | 3/1967 | Hobilt et al. . |
| 3,356,285 | 12/1967 | Greason . |
| 3,445,055 | 5/1969 | Port et al. . |
| 3,608,815 | 9/1971 | Bunch . |
| 3,650,463 | 3/1972 | Christiansen et al. . |
| 3,670,927 | 6/1972 | Hubbard . |
| 3,889,871 | 6/1975 | White . |
| 4,007,838 | 2/1977 | Awad . |
| 4,139,643 | 2/1979 | Hix . |
| 4,322,003 | 3/1982 | Long . |
| 4,759,643 | 7/1988 | Canno . |
| 4,961,503 | 10/1990 | Bell . |

*Primary Examiner*—Joseph Man-Fu Moy

*Attorney, Agent, or Firm*—Merchant, Gould, Smith, Edell, Welter & Schmidt

[57] ABSTRACT

An improved flexible envelope for use as a mailing pouch or evidence preservation package. The envelope is constructed of a metalized polyester material which is characterized by an incision in a wall of said envelope which is sealed by a pressure sensitive adhesively sealed flap. After the flap is folded over and sealed, the user may open the envelope without the assistance of a knife or scissors due to notches at either end of the line of incision which initiate and guide the tearing of the flap. Any attempt to remove or tear open the sealed flap produces tamper evident markings thereon.

4 Claims, 1 Drawing Sheet

TAMPER EVIDENT NOTCHED SEALING ENVELOPE

This is a continuation of application Ser. No. 07/443,821 filed 11/30/89 and issued as U.S. Pat. No. 4,961,503; Application Ser. No. 07/443,821 was a File Wrapper Continuation of U.S. Application Ser. No. 07/169,376 filed 3/17/88, now abandoned.

FIELD OF THE INVENTION

This invention relates to containers or packages for shipment of documents and, more particularly, to a durable metalized polyester envelope with certain characteristics to aid in opening the envelope and to enhance the safety of the documents therein.

BACKGROUND OF THE INVENTION

In the document handling field there has been a long-felt need for a durable, water resistant envelope which is secure against unauthorized or inadvertent opening but which may be intentionally opened with great ease while minimizing potential damage to the contents therein.

Packages constructed from flexible materials such as laminates are well known. Similarly, packages constructed from "oriented materials" are common. Examples of such oriented materials include polypropylene, polyethylene, polystyrene and the like. Such oriented materials may have a high initial resistance to tear or tension breaks, but when once started they will tear with very minor resistance in a nearly straight line without the need for a secondarily imposed guideline of weakness.

Packages and pouches made from fully laminated plies are, of course, also well known and have been provided with opening devices of various sorts, as illustrated in U.S. Pat. No. 3,426,959, which issued to Jerome H. Lemelson on Feb. 11, 1969, and wherein a tear opening is defined by a line portion of the wall of the package, such line portion being of reduced thickness and having means disposed there along for effecting a controlled separation along the line portion.

Various means can be used to form a groove line, or line of weakness, to aid in the opening of packages. In one embodiment of the Lemelson patent, the use of a pair of thinned, parallel lines of weakness of the sides of a tear strip is disclosed. In U.S. Pat. No. 3,186,628 issued to William A. Rohde on June 1, 1965, probes were projected into the path of a thermoplastic film as it was being formed in order to weaken the material. Application of heated bars to areas of a material being formed could also result in areas requiring less tear initiation force. The prior art also illustrates other more sophisticated ways in which lines of weakness can be formed. One such disclosure is made in U.S. Pat. No. 3,909,582, which issued to William Edmund Bowen on Sept. 30, 1975, wherein a laser beam is used to score (i.e. provide a thin groove in) a layer of plastic film in a multilayer laminate. The score line functions as a line of weakness along which the laminate can be torn and, thus, functions as a package opening device.

With respect to tear initiating means, such is varied in the art. In one embodiment the use of a slit between two lines of weakness is disclosed in U.S. Pat. No. 4,139,643, issued to Diana L. Hicks et al. on Feb. 13, 1979. Another form of tear initiating is illustrated in U.S. Pat. No. 3,608,815, issued to Elmo L. Bunch on Sept. 28, 1971, in which a portion of the packaging material to be opened included a minutely expanded section of that material within an area that would ease the initiation and tearing of the package.

The conventional method for opening a sealed flap on a package, pouch or envelope is to manually initiate the release of any available portion of the adhesive area and then to gradually release a progressively wider band or area of the flap from adhesion. This method of opening is difficult and tedious and results in excessive force being employed to effect opening of the package, pouch or envelope. Such force often results in actual tearing of the body of the envelope and damage to the contents therein. Therefore, a natural tendency is to employ mechanical aids such as sharpened letter openers, scissors, or a knife to assist in cutting or tearing open the package. Use of such mechanical aids also causes damage to the envelope contents in the form of slits, cuts, tears and the like.

Accordingly, it is one object of the present invention to provide a means for opening a sealed envelope, including the types described above, which allows for ease of opening while affording greater protection for contained documents. The notched envelope described herein provides such opening means by enabling the person opening the envelope to easily and firmly grasp onto the flap for subsequent removal of same along a narrow band or area of adhesive and a tear axis.

Yet another object of this invention is to provide a tamper evident package for the preservation of evidence. A current method of providing such protection is to place a signed and dated sticker or seal over the openable portion of an evidence preservation packet. However, such seals may be defeated allowing undetected tampering with the evidence in the packet. The notched envelope described herein provides an improved evidence protection package which responds to any opening force along a tear axis by creating permanent striations and crimped regions in the envelope material indicative of any opening attempt.

SUMMARY OF THE INVENTION

This invention relates to a durable metalized polyester envelope and has for an object a tamper evident sealable envelope constructed of strengthened material with a flap which may be removed without the aid of scissors or knife thereby avoiding damage to the contents of the envelope and enhancing the safety of the individual user. The package finds particular use in the secure delivery or mailing of paper documents, and in any use requiring tamper evident packaging such as in the field of evidence preservation.

In accordance with the present invention there is provided an envelope made of a flexible material. The envelope has a transverse incision in one wall through which materials are placed in the envelope. The portion of the envelope above said incision comprises a flap which is folded along a fold axis and sealed to the portion of the envelope below said incision by pressure sensitive adhesive. At either end of said line of incision are notches which serve to initiate and guide the tearing and removal of said flap along said axis.

It is hence the principal object of this invention to provide an envelope of the characteristics described which has a construction that obviates the need to use any mechanical aids in opening, thereby enhancing the safety of the documents within the envelope.

Other objects of this invention will in part be obvious and in part hereinafter pointed out.

BRIEF DESCRIPTION OF THE DRAWINGS

While the specification concludes with claims particularly pointing out and distinctly claiming the subject matter regarded as forming the present invention, it is believed that the invention will be better understood from the following description taken in connection with the accompanying drawings in which.

DETAILED DESCRIPTION WITH PREFERRED EMBODIMENT

Figure 1:
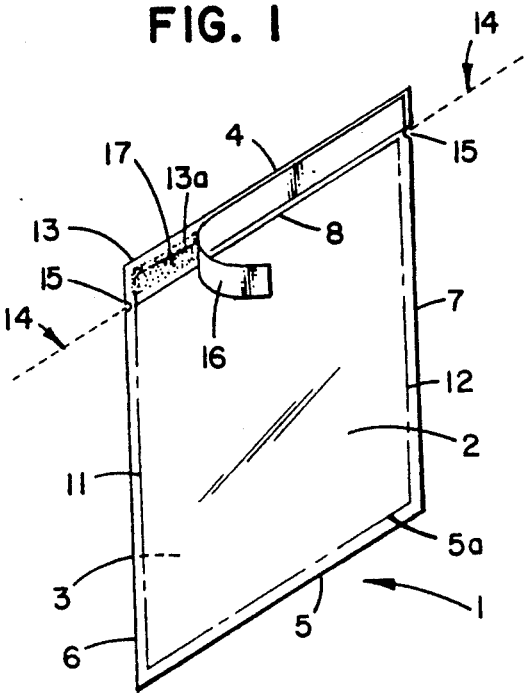
FIG. 1 is a perspective view of an envelope illustrating the application of the notched side edge with paper strip partially removed from the adhesive flap and showing the incision in the envelope immediately below the adhesive flap area.

Referring to FIG. 1 there is shown an envelope 1 of the present invention. The envelope is constructed of a durable metalized polyester material, however various laminates such as nylon/polyethylene, polyester clear/-polyethylene, and the like may be used. The envelope is comprised of a front wall 2 and rear wall 3, of the same size, with a sealed upper end 4 and lower end 5 and opposing side edges 6, 7, and with a transverse incision 8 in said front wall 2, below and parallel to said upper end 4 of said envelope 1, extending along a line between opposing side edge seals 11, 12, through which materials are placed in the envelope. In the preferred embodiment, the side edge seals 11, 12 and a lower end seal 5*a* are formed by heat sealing the front and rear walls 2, 3 together along a strip about ¼–⅜ inch wide. The front wall 2 and rear wall 3 above the incision 8 form a flap 13 which has a fold axis 14 in rear wall 3 along the extended line of the incision 8 in front wall 2.

Figure 2:
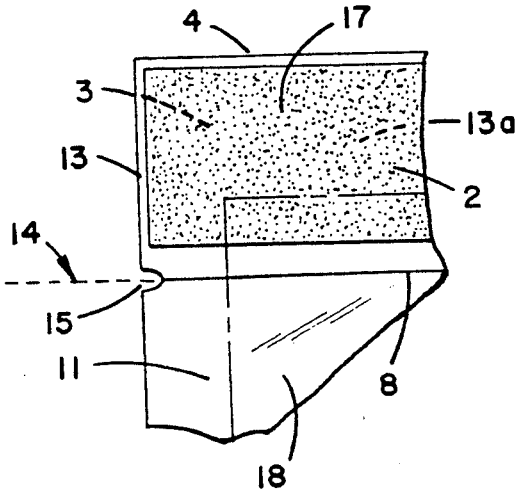
FIG. 2 is a similar view showing the paper strip removed and the adhesive flap folded down and pressed into sealing engagement with the wall of the envelope below the envelope opening.

As shown in FIG. 2, the front and rear walls 2, 3 at the top of the flap 13 are heat sealed together along a strip 13*a* about ½" wide to enhance the rigidity of the flap 13. Preferably at both ends of the fold axis 14, a notch 15 is placed in the side edge seal 11, 12 to initiate and guide the tearing and removal of the flap 13 along the axis 14 after the envelope has been sealed. As shown in FIG. 1, a removable paper strip 16 is peeled from an adhesive area 17 of flap 13 prior to folding the flap 13 along the fold axis 14.

Figure 3:
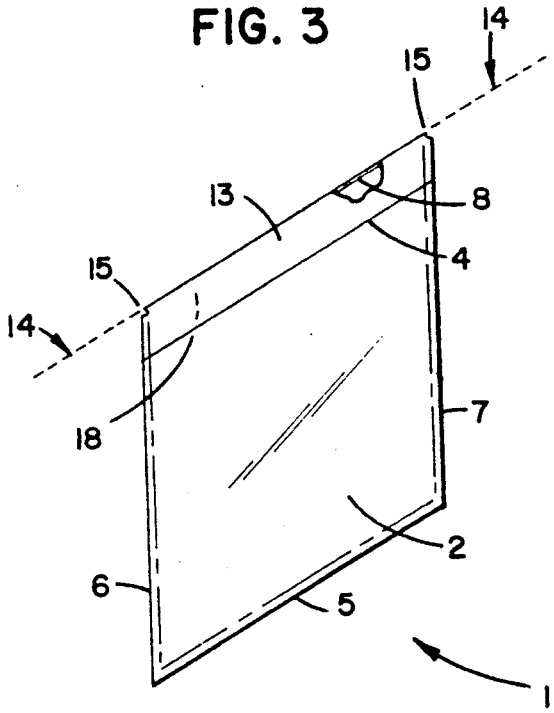
FIG. 3 is a perspective view of the sealed envelope during the opening thereof.

FIG. 3 illustrates the envelope with the flap 13 folded over along the fold axis 14, covering the incision 8, and removeably sealed against an opposed area 18 of the front wall 2 below the incision 8. FIGS. 1, 2 and 3 illustrate that the location of the line of incision 8 in front wall 2 which forms the opening in the envelope is directly beneath and along the fold axis 14 when the envelope is sealed. Therefore, the thickness of the envelope along the fold axis 14 is comprised of only one layer (rear wall 3) of the durable metalized polyester material.

Figure 4:
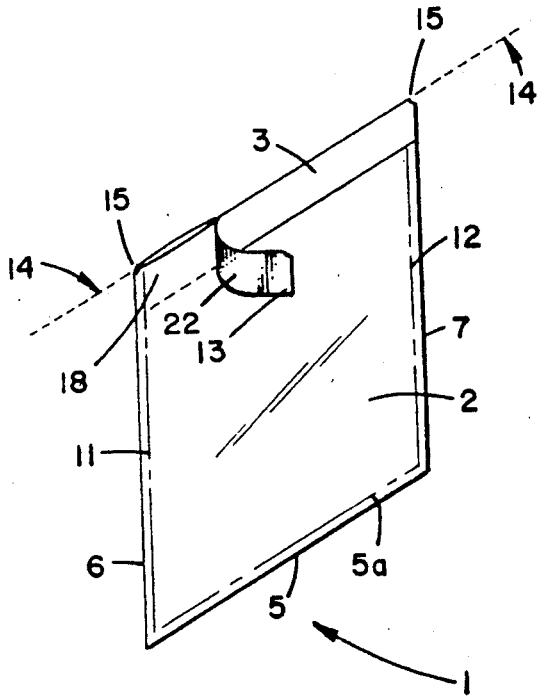
FIG. 4 is an enlarged fragmentary view of the envelope flap, notch and fold axis.

As shown in the partially opened envelope of FIG. 4, the single layer thick material which forms the fold axis 14, although not a line of weakness, defines a tear axis along fold axis 14 as the flap 13 is removed to effect opening of the envelope without risk of tearing the contents therein. As illustrated in FIG. 4, the notch 15 in side edge 11 enables the user to initiate opening the envelope by manually tearing the flap 13 along the fold axis 14 without need of letter opener, scissors or other mechanical aid, thereby avoiding damage to any contents of the envelope while initiating the removal of the flap and the opening of the envelope. A further advantage of the construction of this envelope includes tamper evident markings 22 which are permanently produced on the flap 13 of the envelope whenever the flap is removed in part or entirely. These tamper evident markings 22 are in the form of distinctive striations and crimping effects which are created by the tear force and which are positioned approximately perpendicular to the axis of the tear.

The invention accordingly consists in the features of construction, combinations of elements, and arrangement of parts which will be exemplified in the construction described above and of which the scope of the invention will be indicated in the following claims.

What is claimed is:

1. An arrangement comprising:

(a) an envelope having an open orientation and a closed orientation; said envelope having front and rear walls of flexible material characterized by the absence of perforations therein; said envelope open orientation having:

(i) said front and rear walls sealed to one another along upper and lower ends and opposite side edges to define an envelope interior;

(ii) an incision in said front wall for providing access to said envelope interior, said incision being below said upper ends of said front and rear walls;

(iii) a double wall thickness flap whereat said front and rear walls are sealed to one another; said flap being oriented between said incision and said front and rear wall upper ends;

(iv) pressure sensitive adhesive oriented on a portion of said flap comprising said front wall and oriented between said incision and said front wall upper end;

(v) a flap fold along which said flap is foldable over said front wall incision; said flap fold extending between said first and second side edges; and, said front wall not being sealed to said rear wall along a central portion of said flap fold between said side edges;

(b) said closed orientation having said flap folded along said flap fold and over said incision; and, (c) means facilitating opening of said envelope, when in said closed orientation, by stripping said flap therefrom, along said flap fold.

2. An arrangement according to claim 1 including:

(a) means for leaving striations and crimping in said flap, when said flap is disadhered from said front wall.

3. An arrangement according to claim 1 wherein:

(a) said means facilitating opening includes:

(i) a tear notch in said first side edge aligned with said flap fold; and, (ii) a tear notch in said second side edge aligned with said flap fold.

4. An arrangement according to claim 3 including:

(a) means for leaving striations and crimping in said flap, when said flap is disadhered from said front wall.

* * * * *

UNITED STATES PATENT AND TRADEMARK OFFICE

CERTIFICATE OF CORRECTION

PATENT NO. : 5,046,621

DATED : September 10, 1991

INVENTOR(S) : Gary M. Bell

It is certified that error appears in the above-identified patent and that said Letters Patent is hereby corrected as shown below:

Column 1, line 47, "of" (first occurrence) should read --on--.

Signed and Sealed this

Twenty-first Day of September, 1993

Bruce Lehman

*Attest:*

BRUCE LEHMAN

*Attesting Officer*

*Commissioner of Patents and Trademarks*